United States Patent [19]

Cirino et al.

[11] 4,072,784

[45] Feb. 7, 1978

[54] FIXATION OF MULTIVALENT METAL SALTS OF CARBOXYL-CONTAINING VINYL MONOMERS ON FIBROUS SUBSTRATES

[75] Inventors: Vidabelle O. Cirino, Hereford, Tex.; Stanley P. Rowland, New Orleans, La.

[73] Assignee: The United States of America as represented by the Secretary of Agriculture, Washington, D.C.

[21] Appl. No.: 675,103

[22] Filed: Apr. 9, 1976

Related U.S. Application Data

[63] Continuation-in-part of Ser. No. 501,421, Aug. 28, 1974, abandoned.

[51] Int. Cl.[2] ..... B44D 1/44

[52] U.S. Cl. ..... 428/507; 427/341; 427/342; 427/390 D; 427/391; 428/511; 428/515; 428/907; 428/921

[58] Field of Search ..... 427/341, 342, 385, 390 D, 427/391; 428/507, 511, 515, 907, 921

[56] References Cited

U.S. PATENT DOCUMENTS

| | | | |
|---|---|---|---|
| 2,046,886 | 7/1936 | Strain | 428/256 |
| 2,684,305 | 7/1954 | Quinliuan | 428/256 X |
| 3,083,118 | 3/1963 | Bridgeford | 427/342 X |

OTHER PUBLICATIONS

Methacrylate Resins., DuPont Co., Industrial & Engr. Chemistry, Oct. 1936, pp. 1160–1163.

*Primary Examiner*—Michael R. Lusignan
*Attorney, Agent, or Firm*—M. Howard Silverstein; David G. McConnell; Salvador J. Cangemi

[57] ABSTRACT

Water-soluble multivalent metal salts of carboxyl-containing vinyl monomers are polymerized in situ in fibrous substrates and fixed therein as network polymeric structures. This finish is useful for development of flame retardance, sanitizing characteristics, and other special performance qualities in fibrous compositions and fabrics.

7 Claims, No Drawings

FIXATION OF MULTIVALENT METAL SALTS OF CARBOXYL-CONTAINING VINYL MONOMERS ON FIBROUS SUBSTRATES

This application is a continuation-in-part of Ser. No. 501,421, filed Aug. 28, 1974, now abandoned.

BACKGROUND OF THE INVENTION

The object of the instant invention is to provide a method for polymerizing in situ and durably fixing selected multivalent metal salts of carboxyl-containing vinyl monomers in and on natural fibers and synthetic fibers so that the metal carboxylate polymer may contribute special performance qualities to the fibrous substrate.

Another object of the invention is to provide a new method for rendering textiles flame resistant and mold inhibiting, for conferring resistance to the development of malador from perspiration in textiles, and for developing unique reversible hydroplastic qualities in textiles.

A further object of this invention is to develop self-sanitizing and biocidal qualities in fibrous substrates.

A still further object of this invention is to develop other fabric properties of commercial value by treatment of fibrous substrates with polymerizable multivalent metal-containing vinyl compounds.

It is known that a variety of water-soluble metal salts may be applied to fibrous substrates constituted of cotton or rayon fibers in order to fire proof these substrates; background is summarized by J. E. Ramsbottom ("The Fireproofing of Fabrics," His Majesty's Stationery Office, 1974). Commonly, the effectiveness of these agents was lost after boiling for one hour in water.

It is also known that a variety of metal salts of mercury and silver are effective antibacterial agents, as is, and when applied to fabrics; compounds of metals other than mercury and silver are of lesser importance as antibacterial agents but are more importent for "hidden" antibacterial action: e.g., aluminum and zinc salts applied as ingredients of cosmetic deodorants control bacterial flora of the skin, thereby preventing microbial decomposition and resulting malodor of perspiration in the axillary area. Background information is summarized by R. S. Mohamed (in Chapt. IX "Antibacterial and Antifungal Finishes" of *Chemical Aftertreatment of Textiles,* editors, H. Mark, N. S. Wooding, and S. M. Atlas, Wiley-Interscience, New York, 1971, p. 507) and by E. G. Klarmann (in Kirk-Othmer Encyclopedia of Chemical Technology, 2nd edition, Vol. 2, Interscience Publishers, New York, p. 622).

It is further generally known that the application and fixation of chemical agents on and in fibrous substrates increase the stiffness of the products. This stiffness is only little changed by wetting the composition. It is desirable, however, for the preparation of casts, molds, and rigidly shaped products that there be a transition from a flexible state to a rigid state. It is useful that this be accomplished as the wet fibrous substrate (completely flexible and moldable) looses water to reach equilibrium with ambient conditions of humidity and temperature.

It is known that carboxyl-containing vinyl polymers may be applied to fibrous substrates from aqueous solution, emulsion, or dispersion. Such coatings are limited to the surfaces of the fibrous substrates, often accumulating at fiber crossover points. The in-place neutralization of these coatings to convert them to heavy-metl salts occurs slowly and often with loss of some of the carboxyl-containing polymer. Moreover, the predominant deposition of these polymers on the surfaces of the fibrous materials has a detrimental effect on the overall balance of performance properties.

It has now been found that polymers of multivalent metal salts of water-soluble carboxyl-containing vinyl monomers can be deposited, efficiently polymerized in situ, and durably fixed in and on natural and synthetic fibers in compositions ranging from 100% cellulosic or natural fiber to 100% synthetic fiber by a process that involves a water-soluble polyvalent metal salt of a carboxyl-containing vinyl monomer, preferably with a small fraction of a water-soluble di- or polyfunctional vinyl monomer, and a free radical initiator applied from aqueous solution to the fibrous substrate and cured under specific conditions.

In accordance with the present invention, a process is provided for depositing polymer in and on various substrates with effectiveness for imparting flame retardancy, mold inhibition, resistance to the development of malodor from perspiration, and reversible plasticity in transition from the wet to the dry state.

The process is comprised of a treatment of the fibrous structure or textile material with the metal salt of the carboxyl-containing vinyl monomer, the presence or absence of an additional water-soluble monofunctional vinyl monomer, and a di- or polyfunctional vinyl monomer that are curable to network structures and durable finishes, imparting the above-mentioned properties to the fibrous substrates.

It was unexpectedly discovered that the forementioned metal salt vinyl monomers, in contrast to the free acid vinyl monomers can be polymerized to high conversions of monomer to polymer in and on fibrous substrates and that the polymers are durably fixed in and on these substrates. The metal salts of the carboxyl-containing vinyl monomers, together with the comonomers, penetrate well into the void and pore structures of fibers, especially fibers of the cellulosic and protein classes. The network polymeric structures are developed in these regions of the fiber as well as on the surfaces of the fibers; the results are relatively low contribution of the network polymer at low add-ons to the development of stiffness in the fibrous substrate and relatively high durabilities of the polymeric network structure.

It will become apparent in the light of illustrations and examples that the instant process provides a simple means for developing network structures involving metal salts of carboxyl-containing vinyl monomers. These metal salt-containing fibrous substrates have interesting performance qualities, especially reduced flammability of the substrates, increased durability of cellulosic substrates upon exposure to soil and weather, attractive self-sanitizing characterisitics, and unique plasticities. These performance characteristics are not achieved in similiar degree by impregnating a metal base into the pre-deposited carboxyl-containing polymer nor by coating fibrous substrates with heavy-metal neutralized carboxyl-containing polymer materials. The latter become insoluble during initial combination of the heavy-metal base and the carboxyl-containing polymer prior to contact with the fibrous substrate, and in any case, these coatings, once deposited, are limited to the outermost surfaces of the fibers and, because the network structure is limited to ionic crosslinks rather than to the carbon-chain crosslinks as the case in this invention, the polymeric deposits are nondurable.

In order to achieve desired conversions of heavy-metal containing monomers to polymers, desired fixation of polymers to substrates, and desired performance properites in the finished fibrous substrates, it is necessary to conduct the reaction with water-soluble free-radical initiators and to carry out the curing step under controlled conditions such that contacts with air during this stage are not excessive. In general, the curing step may be conducted in complete presence of air when the transfer of the heat to the substrate is achieved through conduction from hot solid surfaces, such as rolls "cans," calender, press, or conventional household iron. Transfer of heat might likewise be conducted without special precuations regarding the presence of air when the heat transfer medium involves steam or vapors, such as those from chlorinated hydrocarbons that are commonly used in textile and drycleaning operations. However, when the transfer of heat is conveyed through the gaseous state, it is desirable that air be diluted with an inert gas such as nitrogen or carbon dioxide or that it be diluted with steam; a direct blast of hot air on the substrate impregnated with the aqueous solution of reagents is undesirable and detrimental to polymerization and fixation. It is not essential that air be completely absent; the extent of dilution that is required is relatively low since the vaporation of water from the reagent solution on the substrate provides a degree of dilution that is sufficient in many cases.

It is desirable in order to achieve the full objective of this invention to include in the reagent formulation small amounts of a water-soluble di-or polyfunctional monomer. The presence of such a monomer in conjunction with a major monomer or monomers has general effects of raising the efficiency of conversion of the monomer to polymer and of improving the durability of the polymer.

The essence of the invention, then, is the discovery that high levels of efficiency of conversion of water-soluble metal salts of carboxyl-containing vinyl monomers to polymers can be realized on fibrous substrates under controlled conditions of cure that are well suited to use in textile mills to obtain modified substrates wherein the reduced combustibility, the biocidal characteristics, the sanitizing properties and the plastic characteristics conferred by the fixed polymers are the basis for valuable performance qualities in fibers, yarns, and textile and paper products.

This invention employs multivalent metal salts of water-soluble carboxyl-containing vinyl monomers. The metal ions involved may be magnesium, calcium, barium, aluminum, titanium, vanadium, chromium, iron, cobalt, nickel, copper, zinc, zirconium, iron, cobalt, nickel, copper, zinc, zirconium, molybdenum, silver, cadmium, beryllium, tungsten, mercury, lead, bismuth, yttrium, and rare earth elements. The water-soluble carboxyl-containing vinyl monomers include acrylic acid, methacrylic acid, and itaconic acid. The concentration of multivalent metal salts of water-soluble carboxyl-containing vinyl monomers range from 1–40 weight percent.

The water-soluble di- or polyfunctional vinyl monomers preferred for the purpose of this invention are methylenebisacrylamide and 1,3,5-triacyloylhexahydro-s-triazine. The concentration of polyfunctional monomers in the solution can vary between 0–3 weight percent.

Monofunctional comonomers are of definite value in this invention to provide facile complexing sites for the metal ion. Preferred comonomers include the following: acrylamide, methyacrylamide, N-methylolacrylamide, N-methylolmethacrylamide, dimethyl-2-hydroxypropylaminemethacrylimide, diacetoneacrylamide, methylolated diacetoneacrylamide, N-vinyl-2-pyrrolidone, hydroxyethylacrylamide, and hydroxyethylmethacrylamide. Other water-soluble acrylic-type monomers may be employed in specific cases; these include hydroxyethyl acrylate and methacrylate, hydroxypropyl acrylate and methacrylate, and dialkylaminoethyl acrylates and methylacrylates. The concentration of monofunctional comonomers ranges from 0–15 weight percent.

Among the catalysts or initiators that are effective and preferred for use in this invention are: ammonium, sodium, and potassium persulfate, hydrogen peroxide, peracetic acid, and t-butylhydroperoxide. The concentration of catalysts in the solution ranges from about 0.03 to about 3.0 weight percent.

A wetting agent, although not essential, is commonly employed to facilitate contact of the aqueous solution of reagents with the surfaces of the fibers in the substrate and to facilitate penetration of the reagents into voids and pores of the fibers. Suitable wetting agents are alkali metal alkylsulfosuccinates and ethylene oxide derivatives of alkylated phenols and high molecular weight alcohols.

The vinyl monomers, the di- or polyfunctional reagent, the initiator, and the wetting agent are dissolved in a suitable amount of water for application to the fiber substrate. The total concentration of monomers in the solution can vary over a wide range, for example between 0.1 and 50%, although the preferred concentrations lie between 1 and 40% by weight.

The reagent solution is applied to the substrate in any suitable manner, but the common and preferred method involves immersion of the fiber substrate in the reagent solution followed by compression of the fiber substrate between rolls to express the excess solution. One or more such sequence of operations is commonly employed. The impregnated fibrous substrates are brought to elevated temperature to activate the initiator and to allow polymerization to occur rapidly and completely. The temperature of cure may range from 75° to 200° C and the periods allowed for initiation and polymerization can range from 120 minutes to approximately 0.5 minutes, the latter time being most appropriate for the highest temperature. Preferred temperatures for cure range from 90° to 160° C with corresponding duration of polymerization of 20 minutes down to one minute.

DESCRIPTION OF PREFERRED EMBODIMENTS

The following examples are given to further illustrate the present invention. The scope of the invention is not, however, meant to be limited to the specific details of the examples.

EXAMPLE 1

Solutions were prepared to contain 17.4 parts of acrylic acid, 0.6 parts of methylenebisacrylamide, 0.6 parts of ammonium persulfate, a trace of wetting agent, and water to bring the total to 100 parts by weight. One portion of this solution was set aside for the use as solution *a*. A second portion of this solution was neutralized with magnesium carbonate to the point that the pH of the solution was 7 and this was designated solution *b*. A third portion of this solution was brought to a pH of 7 with zinc carbonate and was designated solution *c*. Another portion of this solution was treated with aluminum chlorohydroxide and designated solution *d*. The final portion of this solution was neutralized with barium hydroxide to a pH of 7 and designated solution *e*. Swatches of 80 × 80 cotton printcloth were impregnated into these solutions individually, passed through squeeze rolls to remove the excess reagent, and subjected to cure at 120° C for 10 minutes in atmospheres of steam-nitrogen. The swatches of cured fabrics were rinsed thoroughly in very hot running tap water and air dried. Results are summarized in the following table.

| Sample | Conversion (%) | Match Test Angle[1] | Moisture Regain (%) | Water of Imbibition (%) |
|---|---|---|---|---|
| a | 29 | <0°[2] | 6.5 | 32 |
| b | 135[3] | 100° | 12.3 | 42.8 |
| c | 116[3] | 67° | 9.7 | 25.4 |
| d | 82.5 | 75° | 9.4 | 26.1 |
| e | 113[3] | 67° | 9.6 | 32.5 |
| Unmodified cotton | | <0°[2] | 6.3 | 30.8 |

[1]The match test angle for flammability of a sample of fabric has been described by Guthrie et al, Textile Research Journal, 23, 527–32, 1953. An angle of 0° is that between the hands of a clock at 12 o'clock; an angle of 180° is that between the hands of the clock at 6 o'clock; likewise, 90° represents the angle between the hands of a clock at 3 o'clock. A value of 180° in the above table indicates that a sample of fabric suspended vertically does not sustain combustion when the flame is removed. Correspondly, a value of 0° normally indicates that the combustion did not proceed at this angle. The higher the angle, the better the results.

[2]These samples continued to burn at 0°.

[3]The extent of conversion of monomer on fabric to fixed polymer on fabric was based on the weight of the initial air-dried fabric, the wet pickup of a reagent solution, and the weight of the final air-dried fabric. Values of conversion above 100% are due to increases in moisture regain for the polymer-treated cottons.

EXAMPLE 2

To a solution of 1.95 parts of acrylic acid and 0.1 part of methylenebisacrylamide in 100 parts of tetrahydrofuran were added five parts of titanium tetrachloride. The addition was conducted slowly and was accompanied by the formation of a white precipitate. The insoluble solid was removed and the tetrahydrofuran solution was concentrated to a thick syrup under vacuum. The syrup was dissolved in water, 0.07 parts of ammonium persulfate were added, and cotton fabric was impregnated in this solution. The impregnated swatch of fabric was subjected to a cure at 120° for 10 minutes in a steam-nitrogen atmosphere, and subsequently, was washed vigorously in very hot running tap water. The sample of fabric was found to contain 3.7% of titanium and 2.0% of polyacrylic acid by weight. A sample of this treated cotton fabric showed a match test angle of 120°: i.e., the sample no longer supported combustion at 120° after ignition at 180° and rotation to 120°.

EXAMPLE 3

Swatches of cotton fabric were immersed in reagent solutions similar to those described in Example 1, squeezed to remove excess reagent solution, cured for ten minutes at 120° in steam-nitrogen atmosphere, washed vigorously in very hot running tap water for 20–30 minutes, and air dried at room temperature. Samples of these treated fabrics were analyzed for metal ion content and for percent moisture. The results are as follows: Cotton fabric treated with magnesium acrylate reagent solution, 1.3% Mg, and 9.9% moisture; cotton fabric treated with zinc acrylate solution, 5.5% Zn, and 6.4% moisture; cotton fabric treated with aluminum acrylate reagent, 1.55% Al, and 6.52% moisture; and cotton fabric treated with barium acrylate reagent solution, 10.5% Ba, and 7.0% moisture. Samples of the barium acrylate-treated cotton fabric were impregnated with aqueous solutions containing 9% of dimethyloldihydroxyethyleneurea, 0.2% of wetting agent, 4% of polyethylene softener, and 0.8% of zinc nitrate hexahydrate, and heated in a forced draft oven for 3 minutes at 80° C and then three minutes at 160° C. The samples of fabric, before and after treatment with dimethyloldihydroxyethyleneurea, were subjected to a laundering and drying cycle; the sample of poly(barium acrylate)-cotton given the treatment with dimethyloldihydroxyethyleneurea showed improved durable-press rating. After four more laundering and drying cycles, the loss of weight of these samples of fabric was 2.2%, which was essentially identical to that (2.1%) of a conventionally crosslinked cotton fabric.

EXAMPLE 4

Samples of reagent solutions were prepared to contain 10.0 parts of acrylic acid, 7.4 parts of comonomer noted below, 0.6 parts of methylenebisacrylamide, 0.6 parts of ammonium persulfate, 0.1 part of a wetting agent (Tergitol TMN), metal carbonate sufficient to introduce stoichiometric amounts of the metal ion for each carboxyl group or to raise the pH to 7 or above, and water to bring the total to 100 parts by weight. In this case, it was convenient to prepare an initial solution from the acrylic acid and a major portion of the water into which the metal carbonate was introduced prior to the addition of the other ingredients. The comonomers were as follows: (a) acrylamide, (b) N-methylolacrylamide, (c) hydroxyethyl methacrylate, and (d) diacetoneacrylamide. Impregnations of swatches of cotton fabric in these solutions and subsequent steps were conducted as described in Example 1. Portions of these treated fabrics were also given a cure of three minutes at 160° C in a forced draft oven following the fixation treatment at 120° in steam-nitrogen. The samples of fabric were rinsed, boiled in distilled water for 1 hour, and air dried. The efficiencies of conversion of monomers to polymers, based on weight gains after launderings, were (a) 121%, (b) 87%, (c) 94%, and (d) 93%; results were insignificantly different for fixed samples versus the fixed and cured samples.

EXAMPLE 5

A reagent solution was prepared from 14.5 parts of acrylic acid, 0.5 parts of methylenebisacrylamide, 0.483 parts of ammonium persulfate, a trace of wetting agent, calcium hydroxide solution to adjust the pH to the level indicated below, and water to bring the total to 100 parts by weight. Samples of cotton fabric were padded in this solution, passed through squeeze rolls, placed on pin frames, cured for 5 minutes at 120° in an atmosphere of steam-nitrogen, washed thoroughly in hot running tap water, boiled for one hour in distilled water, and air dried. The results are summarized below:

| pH of treating solution | Conversion of monomer to polymer on fabric |
|---|---|
| 1.8 (no $Ca(OH)_2$) | 29% |
| 3.5 | 29% |
| 4.0 | 54% |
| 5.0 | 90% |
| 7.0 | 92% |
| 11.0 | 95% |

EXAMPLE 6

A reagent solution containing acrylic acid, calcium hydroxide, methlenebisacrylamide, ammonium persulfate, and a trace of wetting agent was prepared; the amounts of materials and the conditions of reaction with cotton printcloth were the same as those described in Example 5, but the calcium hydroxide was present to the extent to develop a pH of 11.0. In a second reagent mixture, 0.2 parts of 1,3,5-triacryloylhexahydro-s-triazine (THT) was introduced in place of the methylenebisacrylamide (MBA), and in a third reagent mixture neither of these reagents was present. All treatments of cotton were conducted under the same conditions. The efficiencies of conversion and the durabilities of the polymers on cotton are summarized below.

| Reagent Mixture | Efficiency of Conversion[1] | Retained after 2% Caustic Boil[2] | Retained after acid Treatment[3] |
|---|---|---|---|
| −MBA | 75% | 36% | 0% |
| +MBA | 96% | 72% | 53% |
| +THT | 95% | 75% | 55% |

[1]Determined by weight gain following air-equilibration and drying after a 1-hour boil in distilled water.
[2]Determined by weighing after a 1-hour caustic boil, thorough rinse in distilled water, air-drying, and air-equilibration; this followed the treatment in footnote[1].
[3]Determined by weighing after soaking in 2% acetic acid for one hour and thorough rinsing, air-drying, and air-equilibration; this treatment followed the treatment described in footnote[2]

EXAMPLE 7

A reagent solution was prepared from 9.5 parts of acrylic acid, 0.5 parts of methylenebisacrylamide, 0.5 parts of ammonium persulfate, a trace of wetting agent, 8.2 parts of cupric carbonate, and water to bring the total to 100 parts by weight. Cotton fabric treated with this solution and cured for 3–5 minutes at 120° in a steam-nitrogen atmosphere had an add-on of 4.4%, corresponding to an efficiency of polymerization of 31%. A similar experiment was conducted, but in this case the cupric carbonate was replaced by cobaltous carbonate (7.8 parts). The add-on of network polymer of poly(cobaltous acrylate) was 7.5%, corresponding to an efficiency of polymerization of 56%. When silver oxide was employed as the base for neutralizing the acrylic acid, a network structure of poly(silver acrylate) was fixed on the cotton at similar efficiency of conversion, the fabric turned jet black in color.

EXAMPLE 8

Cotton fabric was treated with a reagent solution consisting of 15 parts of acrylic acid, 0.5 parts of methylenebisacrylamide, 0.5 parts of ammonium persulfate, 8.0 parts of aluminum chlorohydroxide, and water to bring the total to 100 parts by weight. The aluminum content of the finished fabric was 2.8%; this was reduced to 2.2% after the fabric was soaked in 2% acetic acid and then rinsed thoroughly in water.

EXAMPLE 9

A sample of cotton sateen fabric was immersed in a reagent solution consisting of 8.9% lead acrylate, 0.267% methylenebisacrylamide, 0.03% potassium persulfate, and the remainder water. The fabric was put through squeeze rolls to obtain a 90% wet pickup of reagent solution. The fabric was placed on a pin frame, cured for 10 minutes at 120°, washed thoroughly in hot running tap water, and air dried. The add-on was 8%, representing a 100% conversion of monomer to polymer on the fabric.

EXAMPLE 10

Reagent solutions were prepared from individual metal acrylates, methylenebisacrylamide, and ammonium persulfate. Magnesium, barium, calcium, and zinc acrylates were used. Monomer concentrations of metal acrylates varied from 14% to 40%; concentrations of methylenebisacrylamide varied from 0.5% to 1.33%; concentrations of catalyst ranged from 0.5% to 1.33%. In each case, additional base (involving the specific cation) was used if necessary to adjust the pH to 7.0. Samples of cotton sateen fabric were immersed in these reagent solutions, passed through squeeze rolls, cured for 10 minutes at 120°, washed thoroughly, and air dried. Results are summarized below.

| Acrylate | Add-on | Match Test Angle | Hand of Fabric |
|---|---|---|---|
| Magnesium | 97% | 180° | Rigid |
| Magnesium | 50% | 90° | Stiff |
| Magnesium | 33% | 80–90° | Slightly stiff |
| Barium | 42% | 70° | Slightly stiff |
| Barium | 26% | 60° | Full bodied |
| Barium | 20% | 45° | Soft |
| Calcium | 42% | 85–90° | Stiff |
| Calcium | 29% | 80–85° | Stiff |
| Calcium | 20% | 60° | Slightly stiff |
| Zinc | 53% | 85° | Full bodied, soft |
| Zinc | 41% | 85° | Soft |
| Zinc | 29% | 50° | Very soft |

All samples that were stiff when dried to ambient moisture content became soft and pliable when soaked in water. The change was most pronounced for the poly(magnesium acrylate)cotton fabric having an add-on of 97% of polymer. When dry (in equilibrium with ambient temperature and humidity), a strip of the treated fabric 15 mm wide maintained its horizontal status and was capable of supporting a load of 250 grams at a distance of 4 cm from the point at which the strip of fabric was held. When wet, the strip of fabric draped downward incapable of supporting the load from its own weight in the horizontal position. This fabric could be shaped while wet and then dried at elevated temperature or at room temperature to obtain a rigid fabric product that maintained the shape given to it while wet.

EXAMPLE 11

A solution was prepared to contain 12% acrylic acid, 23% basic zirconium acetate, 12% acetic acid, and 0.5% ammonium persulfate. Cotton fabric was padded through this solution, passed through squeeze rolls, cured for 10 minutes at 120°, washed thoroughly and dried. The add-on of polymer to the fabric was 18% corresponding to a 108% conversion of zirconium acrylate to polymer fixed on the fabric. The modified fabric passed the Streak Test (refer to Example 13), whereas unmodified cotton fabric failed the test.

EXAMPLE 12

Samples of cotton sateen fabric were treated with magnesium, calcium, zinc, and barium salts of acrylic acid in the manner described in Example 10. The uniquely large reductions in stiffness of these fabrics in going from the conditioned (70° F, 65% B.H.) to the water-wet state are summarized below.

| Fabric Sample | Wet Stiffness/Conditioned Stiffness |
|---|---|
| Unmodified cotton | 0.9 |
| Poly(magnesium acrylate)-cotton | 0.05 to 0.06 |
| Poly(calcium acrylate)-cotton | 0.018 to 0.025 |
| Poly(zinc acrylate)-cotton | 0.50 to 0.64 |
| Poly(barium acrylate)-cotton | 0.06 to 0.27 |

EXAMPLE 13

Samples of cotton fabric were treated with metal salts of acrylic acid, methacrylic acid, and itaconic acid. Methylenebisacrylamide was present in all cases. The amounts of acid were varied to obtain the levels of add-on that are shown in the table. The metal ion was introduced in the form of the oxide or hydroxide in stiochiometric equivalence to the carboxyl group, unless indicated otherwise. The curing reactions were conducted in forced draft ovens at 120° C for 10 minutes. The resulting fabrics were boiled for 1 hour in distilled water, air-dried, and air-equilibrated. The samples of fabric were tested for antibacterial activity by the Streak Test (AATCC Test A2) which is a modification of the Agar Plate Method (W. Engle, "Self-Sterilizing Surfaces," Witherby, London, 8pp (1952)).

| Acid | Metal Ion | Add-on of Polymer | Streat Test[1] | Fabric Type |
|---|---|---|---|---|
| Acrylic | Mg | 30% | M | Printcloth |
| " | Ca | 28 | P | Sateen |
| " | Ca | 20 | P | " |
| " | Al | 16 | P | Printcloth |
| " | Zn | 32 | $P^{+}$ | " |
| " | Zn | 28 | $P^{+4}$ | Sateen |
| " | Ba | 26 | P | Sateen |
| " | Cu | 4 | $P^{+2}$ | Printcloth |
| " | Ag | ca. 1 | $P^{+8}$ | " |
| " | Co | 7 | p | " |
| " | Ni | 4 | F | " |
| " | Fe | 4 | P | " |
| Methacrylic | Zn | 4 | P | " |
| Itaconic[2] | Zn | 6 | P | " |
| None | None | None | F | Printcloth |
| None | None | None | F | Sateen |

[1]P = pass, indicating no undergrowth (superscript indicates mm zone of inhibition) or very slight undergrowth; M = marginal, indicating slight undergrowth; and F = fall, indicating undergrowth or heavy undergrowth.
[2]This was half neutralized with Zn.

A wide variety of fibrous substrates, such as batting, pickerlap, sliver, roving, yarn, pressed sheets, or paper, may be treated equally as well as fabric which has served as the substrate in the foregoing examples. The substrates may consist of natural fibers or synthetic fibers; cellulosic fibers with or without polyester, nylon, or acrylic fibers are the preferred substrates.

EXAMPLE 14

A solution was prepared in the manner described in Example 1 c to contain 1.09% of zinc acrylate, 0.025 of THT, and 0.075% of potassium persulfate. Cotton fabric was treated in the manner described in Example 1. The weight gain was 1.03%. The fabric was laundered and dried for 25 cycles. At this point it showed 100% effectiveness in reduction of *Staphylococcus epidermidis* in the modified Quinn test. (This example illustrates about minimum concentration of primary metal salt monomer.)

EXAMPLE 15

A reagent bath was prepared in the manner described in Example 1 to contain 40% of magnesium acrylate, 3.0% of MBA, and 3.0% of ammonium persulfate. Fabric treated in this solution and cured for 5 minutes at 150° C had an add-on of 35% and showed reduced rate of combustion when ignited. (This illustrates concentrations of primary monomer and initiator which are considered to be suitable upper limits.)

EXAMPLE 16

A solution was prepared to contain 3% of zinc itaconate, 15% of acrylamide, 0.5% of MBA, and 0.5% of ammonium persulfate. A series of cotton/polyester fabrics was treated with this solution and cure was conducted at 140° C for 8 minutes. After laundering with Tide, the weight gains of the fabrics were found to be as follows: 100% cotton, 12%; 65% cotton, 11%; 50% cotton, 8%; and 35% cotton,, 4%. All samples of fabric rated P (pass, indicating no undergrowth) in the Streak Test involving *Staphylococcus anreus* and *Escherichia coli.* (This examples illustrates utilization of comonomer at high level of concentration.)

We claim:

1. A process for preparing cellulosic or synthetic fibers having anti-bacterial properties, flame retardancy and sanitizing characteristics comprising:

(a) immersing a cellulosic or synthetic fiber in an aqueous solution containing about 1–40 weight percent of a water soluble polyvalent metal salt of a carboxyl containing acrylic or vinyl monomer, about 0-3 weight percent of a water soluble polyfunctional vinyl monomer, about 0–15 weight percent of a monofunctional vinyl comomomer and about 0.03 to 3.0 weight percent of a free radical initiator;

(b) squeezing the immersed fiber from step (a) to remove the excess solution;

(c) curing the squeezed fiber from step (b) at a temperature of 120°–160° C.;

(d) washing the cured fiber from step (c); and (e) drying the washed fiber from (d).

2. The product prepared by the process of claim 1.

3. The process of claim 1 wherein said fibers are incorporated into a woven textile prior to being wetted in step (a).

4. The process of claim 1 wherein the polyvalent metal salt is formed from an ion selected from the group consisting of calcium, barium, aluminum, vanadium, zinc, zirconium, molybdenum, cadmium, beryllium, tungsten, mercury, lead, bismuth, yttrium, and rare earth elements ions.

5. The process of claim 1 wherein the carboxyl containing acrylic or vinyl monomer is selected from the group consisting of acrylic acid, methacrylic acid and itaconic acid.

6. The process of claim 1 wherein the polyfunctional vinyl monomer is selected from the group consisting of methylenebisacrylamide, and 1,3,5-triaryloylhexahydro-s-triazine.

7. The process of claim 1 wherein the monofunctional vinyl comonomer is selected from the group consisting of acrylamide, methacrylamide, N-methylolacrylamide, N-methylolmethacrylamide, dimethyl-2-hydroxypropylaminemethacrylamide, diacetoneacrylamide, methylolated diacetone acrylamide, N-vinyl-2-pyrrolidone, hydroxyethylacrylamide, and hydroxyethylmethacrylamide.

* * * * *